US005462336A

United States Patent [19]

Desanta

[11] Patent Number: 5,462,336

[45] Date of Patent: Oct. 31, 1995

[54] OFFICE CHAIR HAVING A SUPPORT MEMBER FOR SHIFTABLY SUPPORTING A SEAT

[76] Inventor: Simon Desanta, Schlossallee 18, D-33829 Borgholzhausen, Germany

[21] Appl. No.: 142,296

[22] PCT Filed: Mar. 18, 1993

[86] PCT No.: PCT/EP93/00644

§ 371 Date: Jan. 19, 1994

§ 102(e) Date: Jan. 19, 1994

[87] PCT Pub. No.: WO93/18687

PCT Pub. Date: Sep. 30, 1993

[30] Foreign Application Priority Data

Mar. 20, 1992 [DE] Germany ..... 42 09 066.0

[51] Int. Cl.[6] ..... A47C 3/20

[52] U.S. Cl. ..... 297/302.4; 248/601

[58] Field of Search ..... 297/295, 296, 297/297, 300, 302, 301, 326, 451; 248/601

[56] References Cited

U.S. PATENT DOCUMENTS

| | | | |
|---|---|---|---|
| 1,271,747 | 7/1918 | Nagy | 248/601 |
| 3,053,571 | 9/1962 | Fox . | |
| 4,509,793 | 4/1985 | Wiesmann et al. | 297/302 |
| 4,603,905 | 8/1986 | Stucki | 297/300 |
| 4,640,548 | 2/1987 | Desanta | 297/301 X |
| 4,641,885 | 2/1987 | Bräuning . | |
| 4,871,208 | 10/1989 | Hodgdon . | |
| 5,195,801 | 3/1993 | Franck et al. | 297/300 X |

FOREIGN PATENT DOCUMENTS

| | | | |
|---|---|---|---|
| 0049310A1 | 4/1982 | European Pat. Off. . | |
| 185388 | 6/1986 | European Pat. Off. | 297/300 |
| 0271962A2 | 6/1988 | European Pat. Off. . | |
| 2460649 | 3/1981 | France | 248/623 |
| 929087 | 5/1955 | Germany | 248/601 |
| 931977 | 7/1955 | Germany | 248/601 |
| 3724605 | 2/1989 | Germany | 297/301 |

*Primary Examiner*—Kenneth J. Dorner
*Assistant Examiner*—David E. Allred
*Attorney, Agent, or Firm*—Spencer, Frank & Schneider

[57] ABSTRACT

An office chair comprises a column projecting from a pedestal, a seat, a back rest and a bracket projecting from the upper end of the column forwards. The seat is supported by the front end of the bracket in a first transverse pivot axis. A support member is supported in the central portion of the bracket by a second transverse pivot axis and extends below the seat up to the back rest which is carried by the support member. The support member is resiliently supported by the column and/or the bracket. The rear end portion of the seat is shiftably supported by the support member.

8 Claims, 1 Drawing Sheet

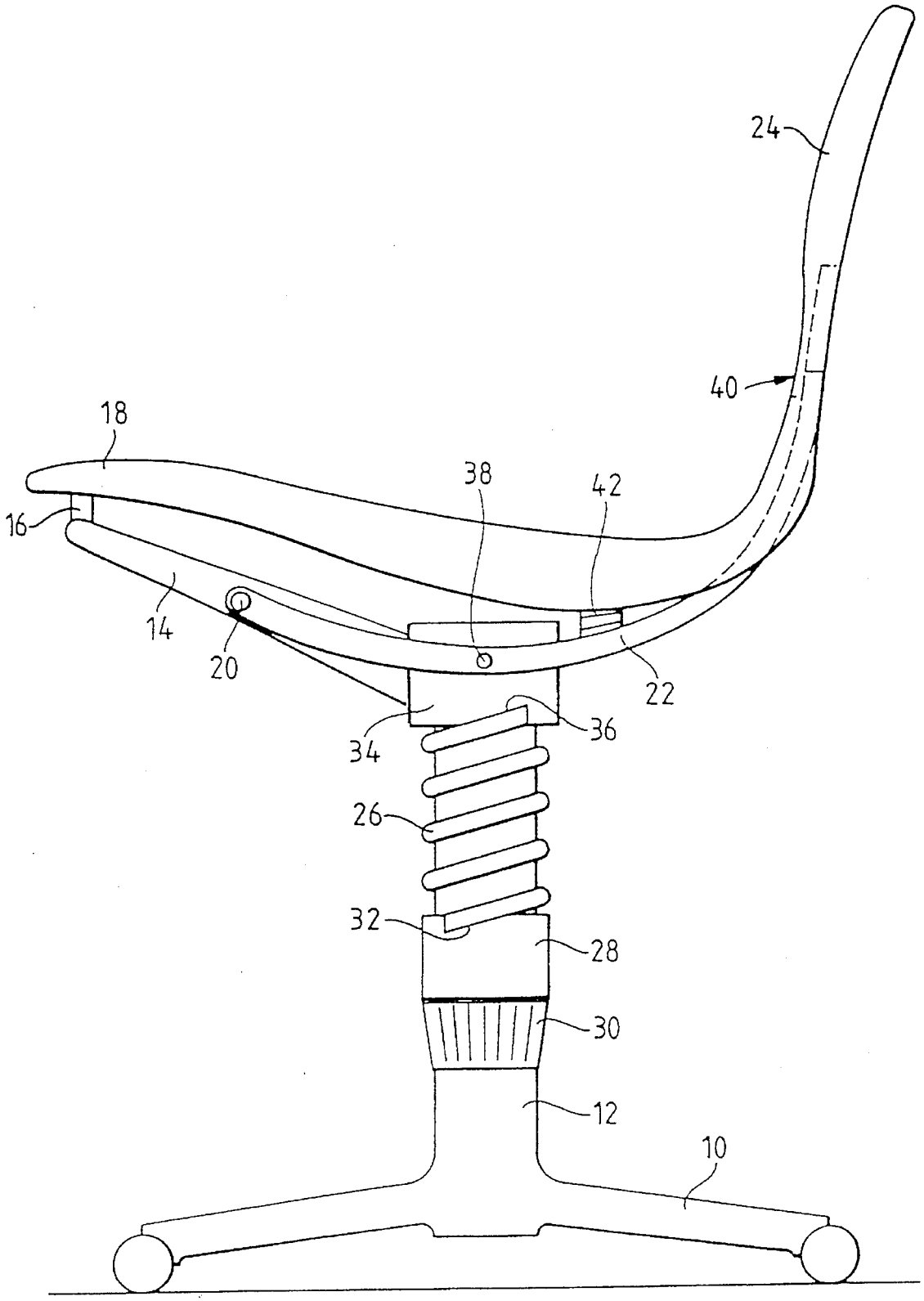
24
40
18
38
42
16
14
20
22
34
36
26
32
28
30
12
10

OFFICE CHAIR HAVING A SUPPORT MEMBER FOR SHIFTABLY SUPPORTING A SEAT

BACKGROUND OF THE INVENTION

The invention relates to an office chair comprising a vertical column rising from a pedestal, a seat, a back rest and a bracket projecting forwards from the top end of the column, the seat being pivotally supported to the front end of the bracket for pivoting around a first transverse axis.

Office chairs of this kind are known in various embodiments.

On the market, there is an increasing need for sable, substantially wear resistant office chairs complying with the ergonomic requirements. In this connection, there is also a need, inter alia, for comparatively simple chairs which can be manufactured and assembled at relatively low cost where the number of parts, particularly movable parts are kept to a minimum and where the parts are arranged in a compact construction concept.

SUMMARY OF THE INVENTION

The above object is complied with by an office chair of the above kind which is characterized in that a support member is journaled in a second transverse pivot axis arranged in the central portion of the bracket, the support member extending below the seat up to the back rest and carrying the back rest, the support member being resiliently supported by the column and/or the bracket, the rear edge portion of the seat being shiftably supported on the support member.

The function of an office chair of this kind is substantially based on the pivotal support member and the spring supporting the support member with respect to the column. The support member supports the rear end portion of the seat and the back rest and allows a simultaneous movement of the seat and the back rest in case of the deflection of the spring in an ergonomically suitable ratio.

For resiliently supporting the support member, the chair preferably, comprises a helical spring surrounding the column in the upper portion thereof. The support member carries a sleeve vertically shiftable on the column which sleeve is supported by the helical spring. The lower end of the helical spring is supported by a support ring which is height adjustable on the column. The support ring may be a threaded ring rotatable on the column or may comprise a threaded ring. By height adjustment of the support ring the spring force may be varied.

The sleeve and/or the support ring may be provided with a helical recess on the sides facing each other which receives the related end of the helical spring. Thus, the helical spring is fixed in its position, and it is not necessary to bend the ends of the helical spring down to the next turn of the spring for obtaining fiat end faces.

The support member comprises at least in the front and central portion of the chair two arms extending identically along both sides of the bracket and the column or the sleeve, respectively. The arms may be connected in the rear portion of the chair.

The first transverse pivot axis connecting the bracket and the front end portion of the seat may be formed by rubber pads allowing a sufficiently formation for pivoting the seat and moreover having a damping effect.

Further features and advantages of the invention may be taken from the subclaims.

The invention will be more easily understood from the following description of embodiments making reference to the drawings.

BRIEF DESCRIPTION OF THE DRAWINGS

The FIGURE is a side view of a chair according to the invention.

DETAILED DESCRIPTION OF THE INVENTION

A column 12 projects vertically from a pedestal 10. At the upper end portion of the column there is a bracket 14 projecting forwards and slightly upwards and be fixed to the column. Terms like front, rear, lateral etc. refer in the present context to the normal sitting position of a person sitting on the chair.

A first horizontal transverse pivot axis 16 connecting the bracket 14 and the seat 18 is positioned in the front end portion of the bracket 14. Thus, the front portion of the seat is pivotally supported by the bracket. The pivot axis 16 may e.g. be formed by rubber pads providing a sufficient deformation in view of the small pivot angle of the seat 18.

A curved support member 22 extends from a second, horizontal, transverse pivot axis 20 provided in the central portion of the bracket 14 and extends below the seat 18 to the back and from there upwards to the back of the back rest 24. The support member 22 consists of two arms in the front and central portion of the chair. One each of the two identical arms is pivotally supported by the axis 20. Each of the arms extends on either respective side of the bracket 14 and the upper portion of the column 12. Behind the column 12 the arms may be connected.

The support member 22 is resiliently supported by a helical spring 26 surrounding the column 12. The helical spring 26 is supported at its lower end by a support ring 28 surrounding tile column. The support ring itself is supported by a rotatable threaded ring 30 engaging a thread on the column and surrounding the column. Thus the height of the helical spring 26 with respect to the column 12 may be adjusted. The support ring 28 has a helical recess 32 on its upper side receiving the lower end of the helical spring 26. Thus the position of the helical spring is fixed, and it is not necessary to bend the last turn of the helical spring to the preceding turn by an additional working step.

The column 12 is surrounded in the upper portion thereof by a shiftable sleeve 34 supported by the upper end of the helical spring 26. The sleeve 34 has an opening (not shown) through which the bracket 14 extends, Moreover, the sleeve 34 has on the lower side a helical recess 36 corresponding to the recess 32 of the lower support ring 28, for receiving the upper end of the helical spring 26. The two arms of the support member 22 extend along either side of the sleeve 34 and are connected with the sleeve by a third, horizontal, transverse pivot axis 38. Thus the support member 22 is supported by the helical spring 26 through the sleeve 34.

The rear end of the seat 18 is shiftably supported by the support member 22. The seat 18 and the back rest 24 are flexibly connected above the rear end of the seat 18 along a connection line 40. Moreover, the rear portion of the seat 18 is supported through a guiding and shifting mechanism 42 on the support member 22, Thus the seat and the back rest achieve a certain movability with respect to the remaining part of the chair mechanism by which blocking of the movements of the chair mechanism is excluded and a comfortable movability of the chair is obtained.

I claim:

1. An office chair, comprising:

a pedestal;

a vertical column rising from said pedestal and having an upper end;

a bracket having a front end, a rear end fixed to the upper end of said vertical column so that said bracket projects therefrom, said bracket having a central portion between said front end and said rear end;

a seat having a rear end portion, a central portion, and a front end portion pivotally supported by the front end of said bracket for pivoting around a first transverse pivot axis, said seat being positioned over the upper end of said column;

a back rest connected to said seat;

a support member journaled to a second transverse pivot axis located in the central portion of said bracket to be resiliently supported by at least one of said bracket and said column, said support member extending below said seat to shiftably support the rear end portion of said seat, and extending up to said back rest to carry said back rest;

a helical spring surrounding said column; and a sleeve shiftably mounted on said column, pivotally connected to said support member to support said support member, and resting on said helical spring, said sleeve including an opening through which said bracket projects.

2. An office chair as defined in claim 1, further comprising a height adjustable support ring located on said column for supporting said helical spring.

3. An office chair as defined in claim 2, wherein said height adjustable support ring is connected to a rotatable threaded ring threadingly engaging said column.

4. An office chair as defined in claim 2, wherein said height adjustable support ring includes a helical recess for receiving a corresponding end of said helical spring.

5. An office chair as defined in claim 1, wherein said sleeve includes a helical recess for receiving a corresponding end of said helical spring.

6. An office chair as defined in claims 1, wherein said support member comprises two substantially identical arms each extending from beneath the front end portion and under the central portion of said seat, and each extending from an opposite side of said bracket and along an opposite side of said sleeve.

7. An office chair as defined in claim 1, wherein the first transverse pivot axis comprises a rubber pad connecting said bracket to a lower side of said seat.

8. An office chair as defined in claim 1, wherein the rear end portion of said seat is connected to a lower end portion of said back rest along a flexible bending line.

* * * * *